US005184442A

United States Patent [19]

Maxwell, Jr. et al.

[11] Patent Number: 5,184,442

[45] Date of Patent: Feb. 9, 1993

[54] EXPANSION JOINT FOR USE WITH DIRECT GLUE-DOWN CARPET

[76] Inventors: Joseph A. Maxwell, Jr., 100 Phillips Knob, Burnsville, N.C. 28714; Stephen P. Maxwell, 22 Green Mountain, Apt. B., Burnsville, N.C. 28714

[21] Appl. No.: 551,541

[22] Filed: Jul. 11, 1990

Related U.S. Application Data

[63] Continuation-in-part of Ser. No. 240,962, Sep. 6, 1988.

[51] Int. Cl.[5] ..... E04F 15/14

[52] U.S. Cl. ..... 52/573; 52/396; 404/47; 404/52

[58] Field of Search ..... 52/393, 394, 396, 573, 52/395; 404/47, 52, 53

[56] References Cited

U.S. PATENT DOCUMENTS

| | | | |
|---|---|---|---|
| 3,183,626 | 5/1965 | Schmitt | 52/396 |
| 3,344,720 | 10/1967 | Hallock | 52/396 |
| 3,659,390 | 5/1972 | Balzer et al. | 52/573 |
| 3,750,359 | 8/1973 | Balzer et al. | 52/573 |
| 4,271,650 | 6/1981 | Lynn-Jones | 52/395 |
| 4,504,170 | 3/1985 | Schukolinski | 52/573 |
| 5,060,439 | 10/1991 | Clements et al. | 52/396 |

*Primary Examiner*—Michael Safavi

*Attorney, Agent, or Firm*—W. Thad Adams, III

[57] ABSTRACT

An expansion joint for joining first and second adjacent segments of direct glue down carpet mounted on respective underlying adjacent first and second floor segments. A first subchannel is mounted in the first floor segment along a joint line of the adjacent first and second carpet segments and a second subchannel is mounted in the second floor segment along the joint line of the adjacent first and second carpet segments in parallel relative moveable relation to the first subchannel. A first cover supports the first of the carpet segments on the first subchannel and a second cover supports the other of the adjacent carpet segments on the second subchannel. A tension bar is positioned in the second subchannel for movement to and from the first subchannel, the tension bar for holding the free edge of the first carpet segment under tension during relative movement between the first and second subchannels thereby allowing expansion and contraction of the adjacent first and second floor segments without stretching or buckling of the overlying direct glue down carpet segments.

6 Claims, 6 Drawing Sheets

EXPANSION JOINT FOR USE WITH DIRECT GLUE-DOWN CARPET

TECHNICAL FIELD OF THE INVENTION

This application is a continuation-in-part of application Ser. No. 240,962, filed on Sep. 6, 1988.

This invention relates to an expansion joint for use with direct glue down carpet and the members by which the expansion joint is fabricated. Use of the term "joint" unless otherwise explained by context refers to the mechanism by which adjacent floor segments are interfaced so that horizontal and vertical expansion and contraction are compensated for in a manner which permits continued utility of the floor without damage to the floor or to pedestrians. The type of floor segments with which this invention has utility is, for example, concrete slab or other fabricated floors such as those used in airport concourses, hospitals and other public areas. Such areas are often carpeted, since carpet provides durability, comfort, safety, and aesthetic qualities not found in tile or other types of floors. Building codes require that such carpeting pass a class 1 flame spread test. In order to pass this test, the carpet must be glued directly onto the subfloor, instead of using padding.

The glued carpet cannot shift, expand, or contract with changes in humidity and temperature, but must move with the subfloor. Large areas of open floor of the type described above expand and contract with the weather, and also settle as the building ages or as subsoil moisture varies. Unless some provision is made for the relative movement of adjacent floor segments as they move and shift, the utility, practicality and safety of this type of flooring is compromised.

SUMMARY OF THE INVENTION

Therefore, it is an object of the invention to provide an expansion joint for use with direct glue-down carpet.

It is another object of the invention to provide an expansion joint which accommodates both hori and vertical movement of adjacent floor panels.

It is another object of the invention to provide an expansion joint which is easy to install and service.

It is another object of the invention to provide an expansion joint which allows expansion and contraction of adjacent floor segments without damage to the carpet.

It is another object of the invention to provide an expansion joint which permits easy removal of the joint elements when needed.

It is another object of the invention to provide an expansion joint which permits proper tension to be maintained on direct glue-down carpet while the joint compensates for expansion and contraction in the adjacent floor segments.

These and other objects of the present invention are achieved in the preferred embodiments disclosed below by providing an expansion joint for joining first and second adjacent segments of direct glue down carpet mounted on respective underlying adjacent first and second floor segments.

The invention comprises a first subchannel for being mounted in the first floor segment along a joint line of the adjacent first and second carpet segments and a second subchannel for being mounted in the second floor segment along the joint line of the adjacent first and second carpet segments in parallel relative moveable relation to the first subchannel. A first cover supports the first of the carpet segments on the first subchannel and a second cover supports the other of the adjacent carpet segments on the second subchannel. Tension means are positioned in the second subchannel for movement with the first subchannel, the tension means for holding the free edge of the first carpet segment under tension during relative movement between the first and second subchannels thereby allowing expansion and contraction of the adjacent first and second floor segments without stretching or buckling of the overlying direct glue down carpet segments.

According to one preferred embodiment of the invention, bridging means support the first and second carpet segments in the space between the first and second subchannels.

According to another preferred embodiment of the invention, the tension means comprises an elongate tension bar.

According to yet another preferred embodiment of the invention, actuating means are carried in the second subchannel and engage the first and second subchannels and the tension means for moving the first and second segments of carpet in response to relative movement between the first and second subchannels.

Preferably, the first and second subchannels comprise extended aluminum.

According to one preferred embodiment of the invention, the tension means includes a flexible connecting member interconnecting the first cover and the tension bar.

According to another preferred embodiment of the invention, the first and second carpet segments are glued onto respective the first and second cover plates.

According to yet another preferred embodiment of the invention, the actuating means includes an actuating pin fixedly secured to the tension bar and engaging the first subchannel, the actuating pin being moved by any contracting movement of the first and second subchannels to move the tension bar secured thereto and thereby maintain tension on the first carpet segment.

According to one preferred embodiment of the invention, an expansion joint for joining first and second adjacent segments of direct glue down carpet mounted on respective underlying adjacent first and second floor segments comprises a first subchannel for being mounted in the first floor segment along a joint line of the adjacent first and second carpet segments and a second subchannel for being mounted in the second floor segment along the joint line of the adjacent first and second carpet segments in parallel relative moveable relation to the first subchannel. A first cover supports the first of the carpet segments on the first subchannel and a second cover supports the other of the adjacent carpet segments on the second subchannel. A bridging plate is positioned intermediate the first and second cover subchannels and is supported on opposing ends thereof by the first and second cover plates for bridging any space between the first and second subchannels. Tension means are positioned in the second subchannel for movement to and from the first subchannel, the tension means for holding the free edge of the first carpet segment under tension during relative movement between the first and second subchannels thereby allowing expansion and contraction of the adjacent first and second floor segments without stretching or buckling of the overlying direct glue down carpet segments.

According to another preferred embodiment of the invention, the bridging plate is pivotally mounted to one or the other of the first and second subchannels.

According to yet another preferred embodiment of the invention, the tension means comprises an elongate tension bar.

According to one preferred embodiment of the invention, actuating means are carried in the second subchannel and engages the first and second subchannels and the tension means for moving the first and second segments of carpet in response to relative movement between the first and second subchannels.

According to yet another preferred embodiment of the invention, first and second adjacent segments of direct glue down carpet are mounted on respective underlying adjacent first and second floor segments, and comprises a first subchannel mounted in the first floor segment along a joint line of the adjacent first and second carpet segments and a second subchannel mounted in the second floor segment along the joint line of the adjacent first and second carpet segments in parallel relative moveable relation to the first subchannel. A first cover is pivotally mounted by one end thereof on the first subchannel and supports the first of the carpet segments on the first subchannel while compensating for any vertical shift of the first subchannel relative to the second subchannel. A second cover is pivotally mounted by one end thereof on the second subchannel and supports the other of the adjacent carpet segments on the second subchannel while compensating for any vertical shift of the second subchannel relative to the first subchannel. Tension means are positioned in the second subchannel for movement to and from the first subchannel. The tension means hold the free edge of the first carpet segment under tension during relative movement between the first and second subchannels thereby allowing expansion and contraction of the adjacent first and second floor segments without stretching or buckling of the overlying direct glue down carpet segments.

According to one preferred embodiment of the invention, an expansion joint for joining first and second adjacent segments of direct glue down carpet mounted on respective underlying adjacent first and second floor segments is provided and comprises a first subchannel for being mounted in said first floor segment along a joint line of the adjacent first and second carpet segments and a second subchannel for being mounted in said second floor segment along the joint line of the adjacent first and second carpet segments in parallel relative moveable relation to said first subchannel. A first cover is pivotally supported by first pivot support means on said first subchannel for supporting the first of the carpet segments on the first subchannel. A second cover is pivotally supported by second pivot support means on said second subchannel for supporting the other of the adjacent carpet segments on the second subchannel. Tension means are provided for being positioned in said first and second subchannels for movement beneath said first and second covers, said tension means including carpet edge grippers for gripping and holding the free edge of the first carpet segment under tension during relative movement between said first and second subchannels thereby allowing expansion and contraction of the adjacent first and second floor segments without stretching or buckling of the overlying direct glue down carpet segments. The tension means comprises a third cover mounted on said first cover for pivotal movement relative to said second subchannels and including flexible support webbing for supporting a length of carpet and a tension bar and actuating pins for gripping the carpet and holding it under tension. First and second elastomeric splines are positioned in respective spaces in said first and second pivot support means for maintaining said first and second covers, respectively, in proper pivot relationship to said respective first and second subchannels.

An embodiment of the method of allowing expansion and contraction of the adjacent first and second floor segments without stretching or buckling of the overlying first and second adjacent direct glue down carpet segments according to the invention comprises the steps of providing a space under the second overlying direct glue down carpet segment, positioning an extended end portion of said first carpet segment into the space under the first overlying direct glue down carpet segment, and connecting said extended end portion of said first carpet segment to tension means responsive to relative movement of said first and second floor segments. In the case of relative movement of said first and second floor segments towards each other, excess carpet is carried under tension into the space under the second overlying carpet segment. In the case of relative movement of said first and second floor segments away from each other, a sufficient length of said extended end portion of said first carpet segment is withdrawn from the space under the second overlying carpet segment to prevent stretching of the carpet.

An embodiment of the method according to the invention comprises the further step of providing pivot means for permitting pivoting movement of said first and second carpet segments relative to each other and to the floor segments to which said first and second carpet segments are respectively attached.

A further embodiment of the method according to the invention comprises the step of providing vertical adjustment means for permitting compensation for relative vertical movement between said first and second floor segments.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENTS AND BEST MODE

Figure 1:
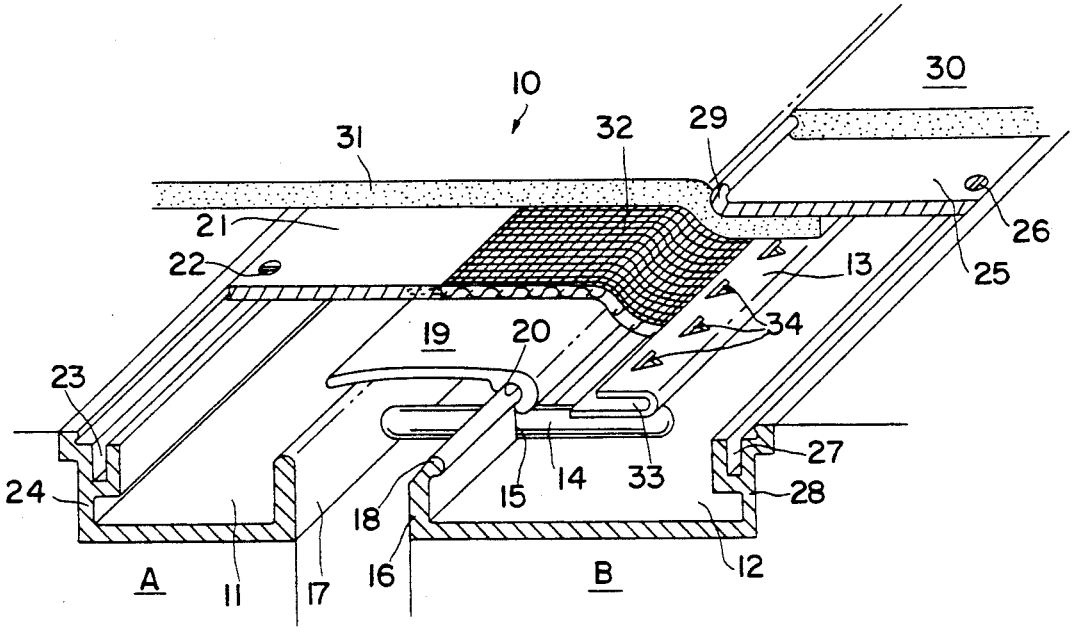
FIG. 1 is a fragmentary perspective view of an expansion joint according to one embodiment of the invention.

Referring now specifically to the drawings, an expansion joint for direct glue-down carpet according to one embodiment of the present invention is illustrated in fragmentary cross-section in FIG. 1 and shown generally at reference numeral 10. The environment within which the invention us used, as described above, is, for example, a wide and large corridor in a hospital or airport. The subfloor comprises adjoining concrete slabs A and B into which a pair of respective subchannels 11 and 12 are set along adjacent edges. Subchannels 11 and 12 are each constructed of extruded aluminum channels having a profile as shown in FIG. 1.

Subchannels 11 and 12 extend along the entire length of the adjacent floor segments A and B and serve as a bed for the other operating components of the invention. Tension means, including an elongate tension bar 13 is positioned in subchannel 12 and extends along its length. Actuating pins 14 are fixedly secured as by welding to the bottom surface of actuating pin 14 at spaced-apart intervals along its length.

Actuating pins 14 extend at right angles to the length of subchannel 12 and extends through matingly spaced-apart holes 15 in a forward side wall 16 in subchannel 12. The end of each actuating pin 14 which protrudes through hole 15 engages a forward side wall 17 of subchannel 11. The upper edge of forward side wall 16 terminates in an elongate rim 18 having an annular profile. An elongate curved bridging plate 19 of extruded aluminum rests by one end on rim 18 by means of a mating annular groove 20, and on the other end across the upper edge of side wall 17 of subchannel 11.

Subchannel 11 is enclosed by a flat extruded aluminum cover plate 21 which is fastened onto subchannel 11 by spaced-apart screws 22 positioned in an elongate groove 23 formed in the rear wall 24 of subchannel 11. Likewise, subchannel 12 is enclosed by a flat extruded aluminum cover plate 25 which is fastened onto subchannel 12 by spaced-apart screws 26 positioned in an elongate groove 27 formed in the rear wall 28 of subchannel 12.

A carpet segment 30 is glued onto the top surface of cover plate 25. Cover plate 25 has an upwardly curved end 29 against which the glued down carpet 30 is abutted. A carpet segment 3 is glued down onto cover plate 21. Carpet segment 31 extends down and under the curved end 29 of cover plate 25 and is fastened to tension bar 13 by teeth 34 on the top of tension bar 13.

A length of a flexible, compression resistant webbing 32 is attached to the forward edge of cover plate 21 and extends over the bridging plate 19 into a slot 33 formed in tension bar 13, where it is securely fastened. The webbing 32, tension bar 13 and actuating pins collectively comprise the tension means referred to above. Carpet segment 31 is also glued down onto the cover plate 21 and the webbing 32 The overall structure of the expansion joint 10 is such that the carpet segments 30 and 31 are ideally flush and level with the entire expanse of the carpet.

Figure 2:
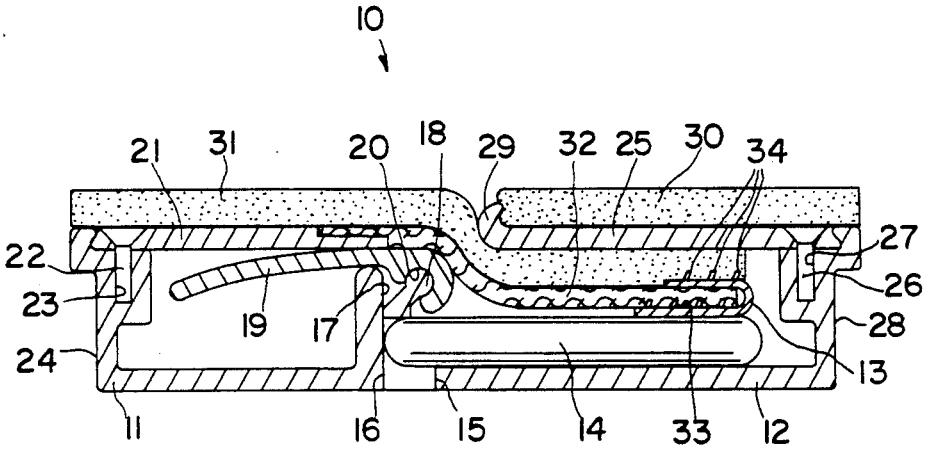
FIG. 2 is a cross-section of the embodiment of the invention shown in FIG. 1 with the joint in a contracted position.

Referring now to FIG. 2, the expansion joint is shown in a contracted position with floor segments A and B abutting each other. As the joint closes, the forward edge 17 of subchannel 11 exerts pressure on actuating pins 14, moving tension bar 13 away from the subchannel 11, pulling with it the leading edge of carpet 31 and webbing 32, maintaining tension on the carpet 31.

Figure 3:
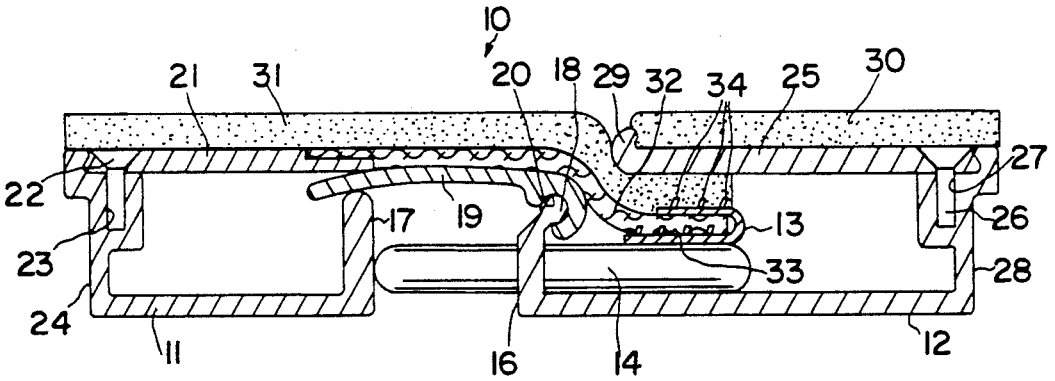
FIG. 3 is a cross-section of the embodiment of the invention shown in FIG. 1 with the joint in an expanded position.

As the joint opens, the cover plate 21 attached to the webbing 32 pulls the webbing 32 and carpet 31 out from beneath cover plate 25. This is shown in FIG. 3. The carpet 31 and webbing 32 are held tight to the floor by the tension bar 1 with the actuating pins 14 pressing against the forward edge 17 of subchannel 11. As carpet 31 passes under cover plate 25 and against webbing 32, it is compressed and causes the nap of the carpet 31 to stand up. This protects the edge of the cover plate 25.

Vertical deflection of one of the floor segments A or B relative to the other of up to about one-quarter inch 0.6 cm) is compensated for by pivotal movement of the bridging plate 19.

Figure 4:
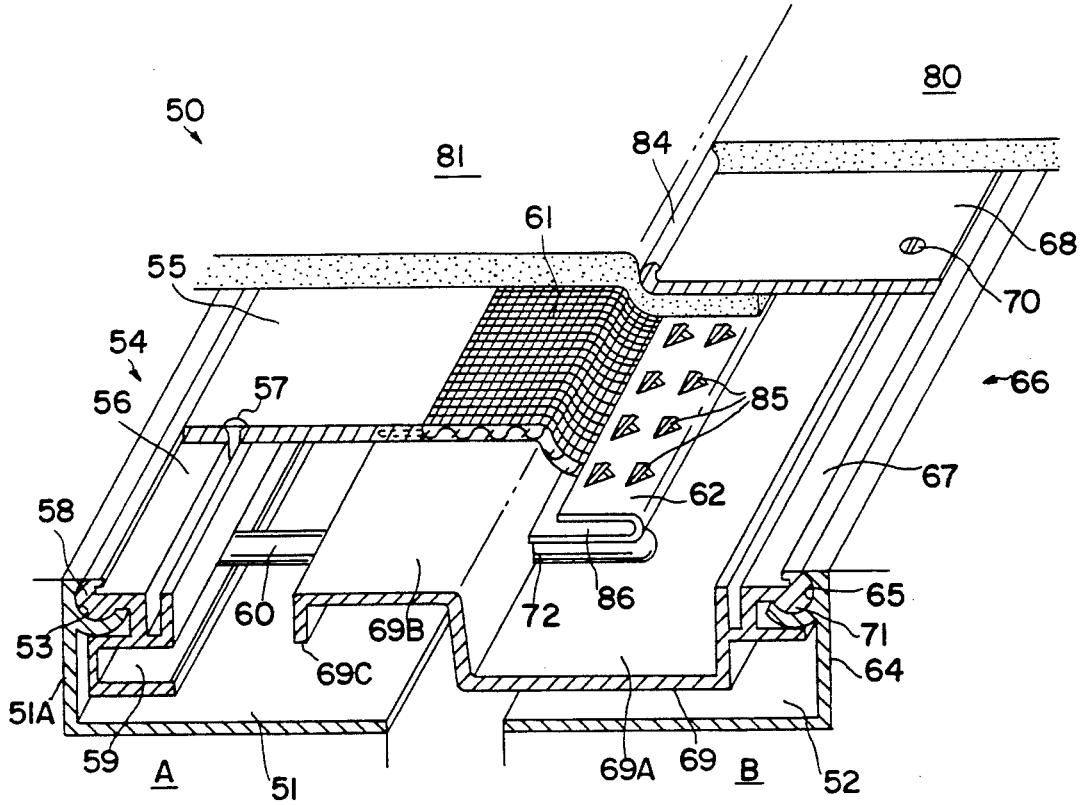
FIG. 4 is a fragmentary perspective second embodiment of the invention.

Referring now to FIG. 4, another embodiment of the invention is illustrated and broadly designated at reference numeral 50. Joint 50 comprises a subchannel 51 positioned on the edge of a concrete floor segment A, and a subchannel 52 positioned on the edge of a concrete floor segment B. Both subchannels 51 and 52 extend along the length of the juncture of adjacent floors segments A and B, and are each formed of extruded aluminum.

Subchannel 51 has a rear wall 52 which terminates in an upwardly directed elongate annular groove 53. A two-piece cover plate 54 is positioned within subchannel 52. Cover plate 54 comprises an elongate extruded aluminum flat plate 55 mounted in an elongated extruded aluminum hinge member 56 by means of spaced-apart screws 57. Hinge member 56 has an elongate annular rim 58 which is adapted to be received in groove 53, thereby permitting cover plate 54 to pivot. Hinge member also includes a groove 59 for receiving one end of a plurality of spaced-apart actuating pins 60.

A length of a flexible, compression resistant webbing 61 is attached to one end of plate 55 and a tension bar 62. Tension bar 62 is securely fastened, as by welding, to the end of actuating pins 60 remote from hinge member 56. The assembly of joint 50 is completed by subchannel 52. Subchannel 52 has a rear wall 64 which terminates in an upwardly directed elongate annular groove 65. A two-piece cover plate 66 is positioned within subchannel 52. Cover plate 66 comprises an elongate extruded aluminum flat plate 68 mounted in an elongated extruded aluminum hinge member 67 by means of spaced-apart screws 70. Hinge member 67 has an elongate annular rim 71 which is adapted to be received in groove 65, thereby permitting cover plate 66 to pivot.

Cover plate 69 includes a section 69A in which tension bar 62 is positioned and into which the actuating pins 60 extend through respective holes 72; a bridging section 69B which is raised above the level of section 69A and supports flat plate 55, and a downwardly extending end section 69C which rests on actuating pins 69C and supports cover plate 66 above the level of the bottom of subchannel 52.

Figure 7:
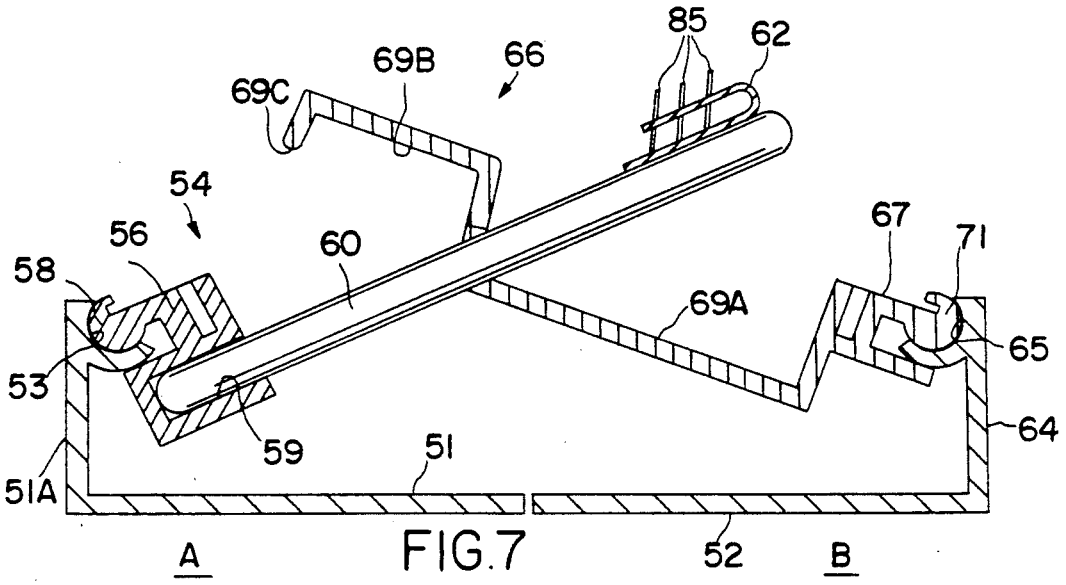
FIGS. 7 and 8 are cross-sectional views of the embodiment shown in FIG. 4, showing assembly and relative movement.
Figure 8:
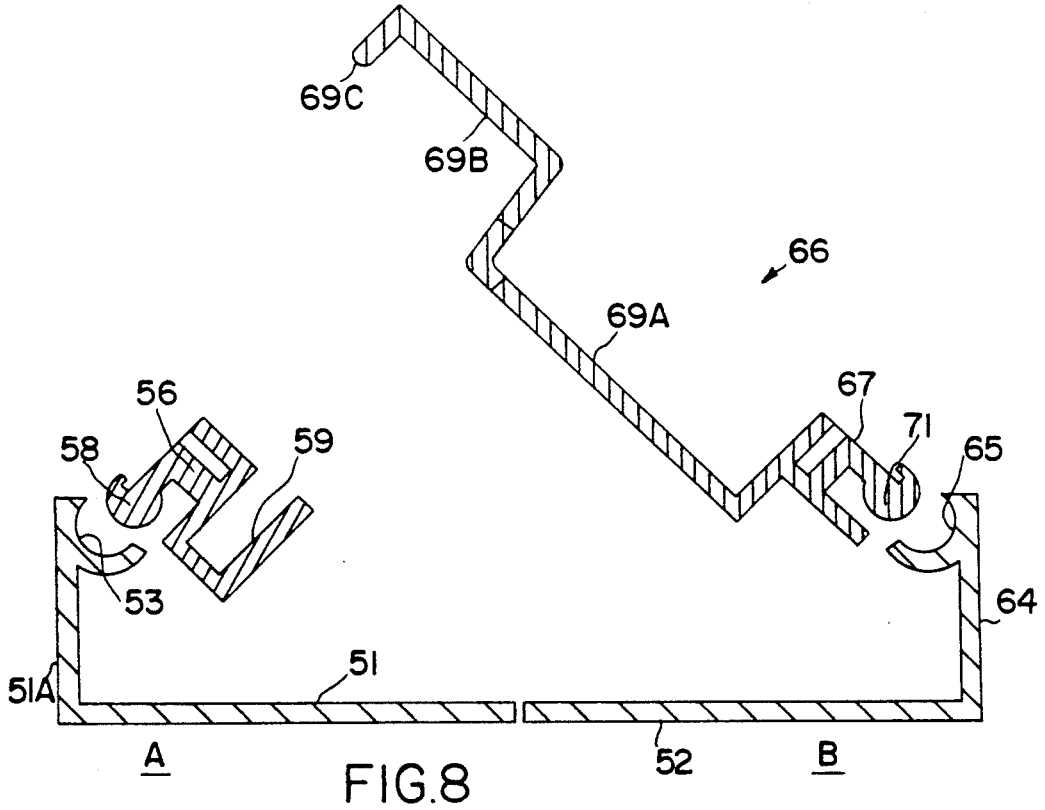

Assembly of subchannels 51 and 52 is illustrated in FIGS. 7 and 8.

A carpet segment 80 is glued onto the top surface of flat plate 68. Cover plate 68 has an upwardly curved end 84 against which the glued down carpet 80 is abutted. A carpet segment 81 is glued down onto flat plate 55. Carpet segment 81 extends down and under the curved end 84 of flat plate 68 and is fastened to tension bar 62 by teeth 85 on the top of tension bar 62.

Webbing 61 is attached to the forward edge of cover plate 55, as described above, and extends over the bridging section 69B into a slot 86 formed in tension bar 62, where it is securely fastened. Carpet segment 81 is also glued down onto flat plate 55 and the webbing 61. The overall structure of the expansion joint 50 is such that the carpet segments 80 and 81 are ideally flush and level with the entire expanse of the carpet.

Figure 5:
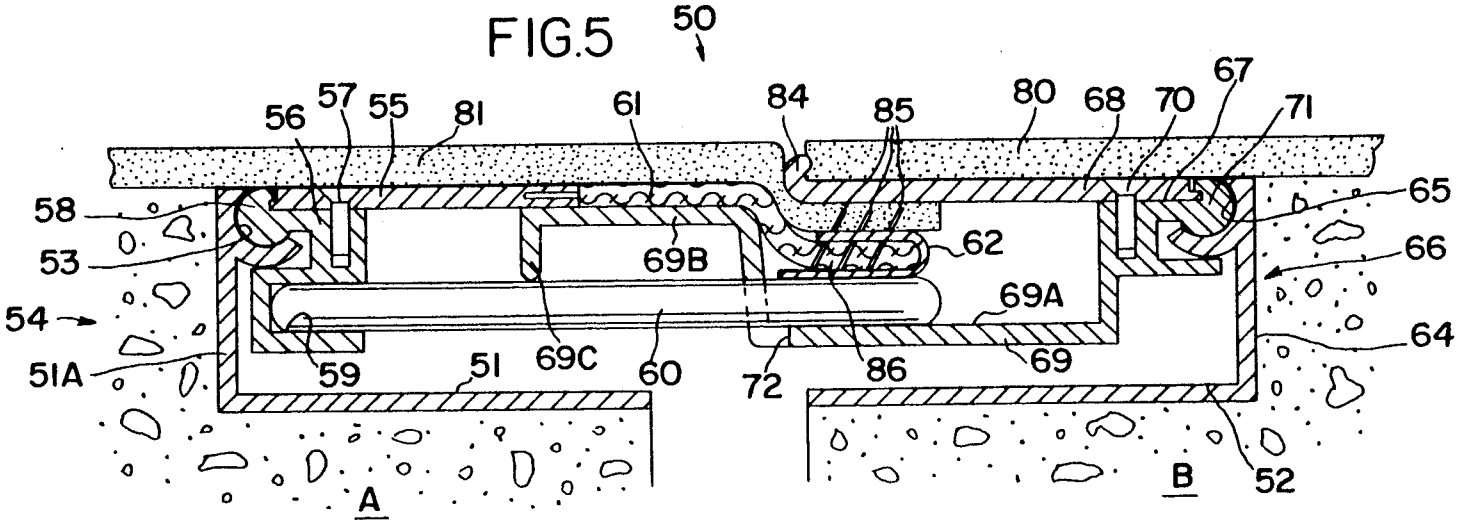
FIG. 5 is a cross-section of the embodiment of the invention shown in FIG. 4 with the joint in a contracted position.
Figure 6:
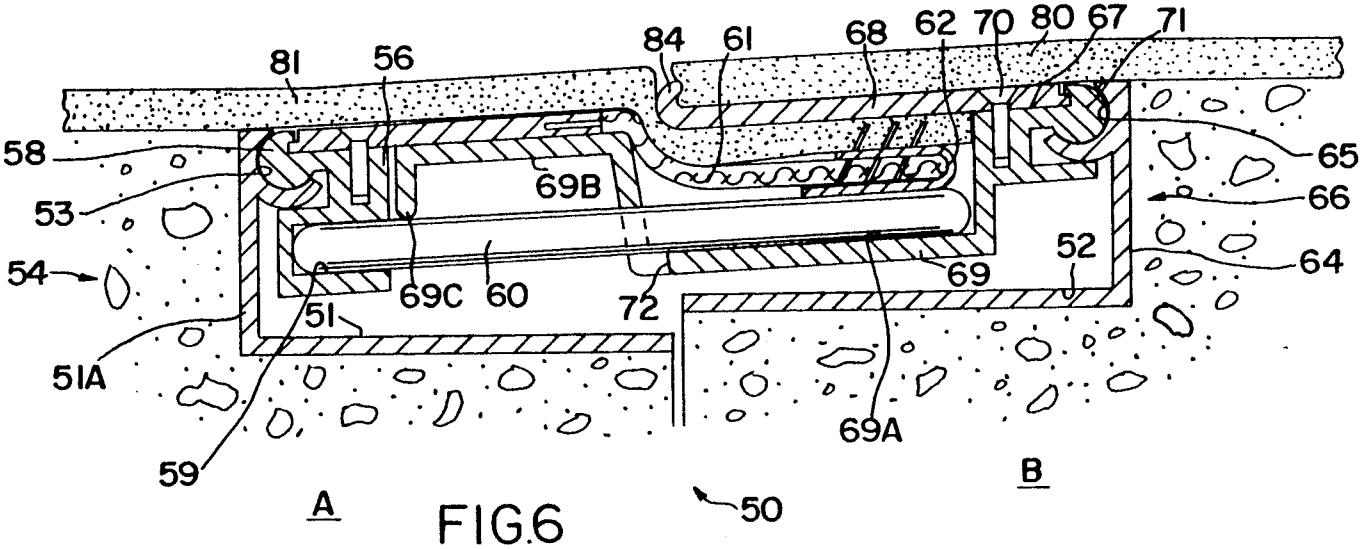
FIG. 6 is a cross-section of the embodiment of the invention shown in FIG. 4 with the joint in an expanded position.

As is shown in FIG. 5, the expansion joint 50 is in an expanded position with floor segments A and B in spaced-apart relation to each other. Referring now to FIG. 6, as the joint closes, the hinge member 56 exerts pressure on actuating pins 14, moving tension bar 60 away from the subchannel 51, pulling with it the leading edge of carpet 81 and webbing 61, maintaining tension on the carpet 81.

As the joint opens, the plate 55 attached to the webbing 61 pulls the webbing 61 and carpet 81 out from beneath plate 68. This is also shown in FIG. 5. The carpet 81 and webbing 61 are held tight to the floor by the tension bar 62 with the actuating pins 60 pressing against the hinge member 56. As carpet 81 passes under plate 68 and against webbing 61, it is compressed and causes the nap of the carpet 81 to stand up. This protects the edge of plate 68.

Vertical deflection of one of the floor segments A or B relative to the other of up to about one inch (2.5 cm.) is compensated for by pivotal movement of the plates 55 and 68 and the bridging segment 69B. The concurrent actions of these components with the action of the actuating pins 60 permits simultaneous compensation of both lateral and vertical shifting to a degree not possible in the embodiment illustrated in FIGS. 1-3. The effect of the compensating movement described above is that a gentle ramp is created which can be easily avoided by pedestrians without tripping. Unsightly, hazardous and wear-inducing wrinkles and ridges are prevented, as is separation of the carpet from the floor.

Referring now to FIGS. 9, 10, 11 and 12, these two embodiments have constructions which eliminate the need for screws, provides insulative material which buffers sounds caused by touching adjacent metal parts and keeps dirt out, and is easy to assemble and disassemble.

Figure 9:
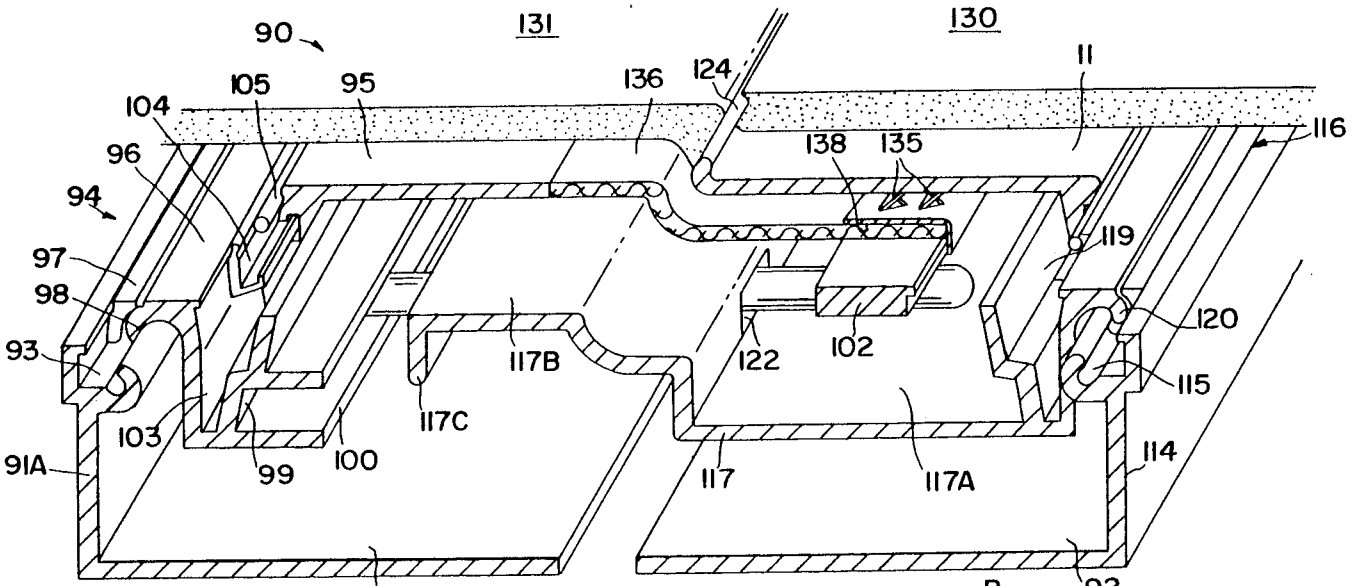
FIG. 9 is a fragmentary perspective view of a further embodiment of the invention.
Figure 10:
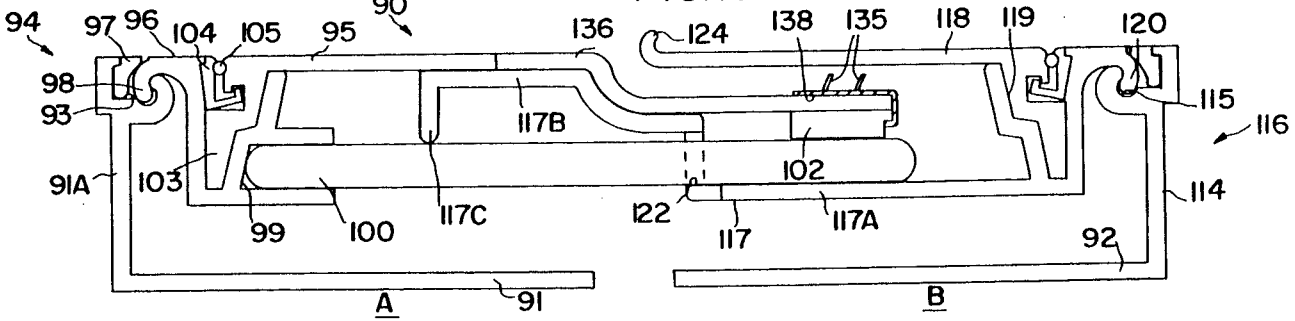
FIG. 10 is a cross-section of the embodiment of the invention shown in FIG. 9.

As is shown in FIGS. 9 and 10, another embodiment of the invention is illustrated and broadly designated at reference numeral 90. Joint 90 comprises a subchannel 91 positioned on the edge of a concrete floor segment A, and a subchannel 92 positioned on the edge of a concrete floor segment B. Both subchannels 91 and 92 extend along the length of the juncture of adjacent floors segments A and B, and are each formed of extruded aluminum.

Subchannel 91 has a rear wall 91A which terminates in an upwardly directed elongate annular groove 93. A two-piece cover plate 94 is positioned within subchannel 91. Cover plate 94 comprises an elongate extruded aluminum flat plate 95 mounted in an elongated extruded aluminum pivoting cover plate 96. Flat plate 95 has a rear wall 95A which fits into groove 103. Rear wall 95A has a groove 95B. Cover plate 96 is pivotally mounted in annular groove 93, and an elongate extruded vinyl retainer spline 97 retains cover plate 96 in groove 93. Cover plate 96 has an elongate annular rim 98 which is adapted to be received in groove 93, thereby permitting cover plate 94 to pivot. Cover plate 96 also includes a groove 99 for receiving one end of a plurality of spaced-apart actuating pins 100.

A length of a flexible, compression resistant webbing 101 is attached to one end of plate 95 and a tension bar 102. Tension bar 102 is securely fastened, as by welding, to the end of actuating pins 100 remote from cover plate 96.

As noted above, cover plate 96 includes a groove 103 into which is fitted an elongate clip 104. An extruded vinyl spline 105 fits between clip 104 and rear wall 95A, locking clip 104 into groove 95B and allowing plate 95 to snap into groove 103, locking plate 95 and plate 96 together. Splines 97 and 105 lock the adjacent parts together, prevent entry of dirt, dampen noise and eliminate the need for screws.

The assembly of joint 90 is completed by subchannel 92. Subchannel 92 has a rear wall 114 which terminates in an upwardly directed elongate annular groove 115. A two-piece cover plate 116 is positioned within subchannel 92. Cover plate 116 comprises an elongate extruded aluminum flat plate 118 mounted in an elongated extruded aluminum cover plate support 117 by means of a groove 119.

Figure 11:
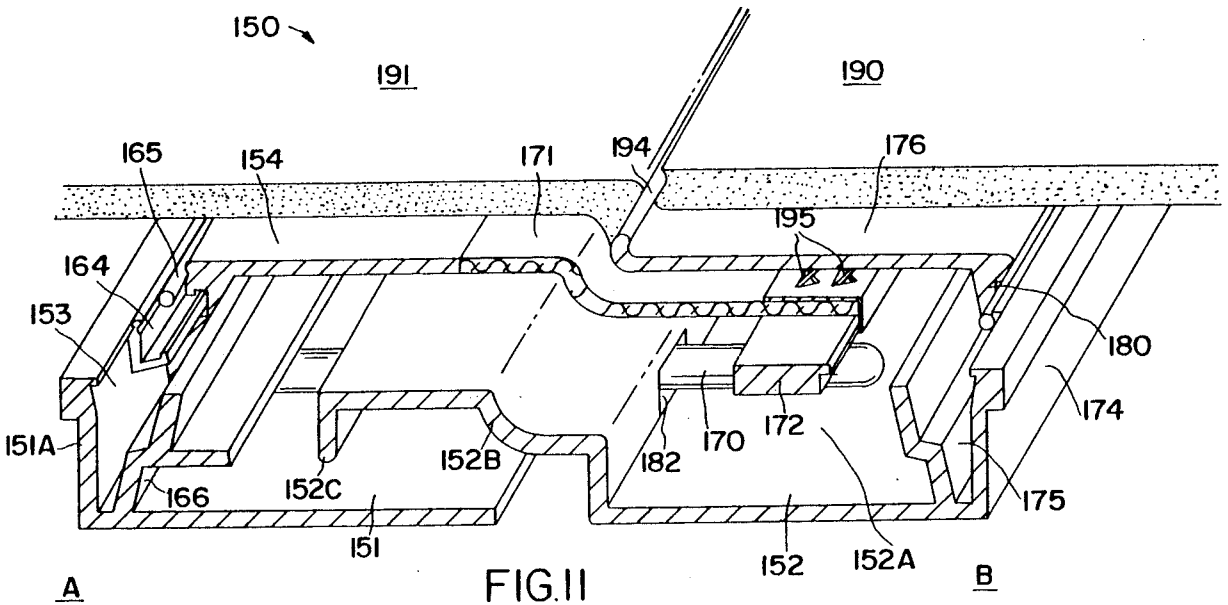
FIG. 11 is a fragmentary perspective view of a further embodiment of the invention.

An elongate clip 104 is positioned in groove 119 and an extruded vinyl spline 105 fits over the clip 104 with a press fit, as is best shown in FIG. 11, and holds the cover plate 176 in subchannel 152. Spline 105 locks the adjacent parts together, prevents entry of dirt, dampens noise and eliminates the need for screws.

Cover plate support 117 has an elongate annular rim 120 which is adapted to be pivotally received in groove 115, thereby permitting cover plate 117 to pivot.

Cover plate support 117 includes a section 117A in which tension bar 102 is positioned and into which the actuating pins 100 extend through respective holes 122; a bridging section 117B which is raised above the level of section 117A and supports flat plate 95, and a downwardly extending end section 117C which rests on actuating pins 100 and supports cover plates 95 and 96 above the level of the bottom of subchannel 91.

A carpet segment 130 is glued onto the top surface of flat plate 118. Cover plate 118 has an upwardly curved end 124 against which the glued down carpet 130 is abutted. A carpet segment 13 is glued down onto cover plate 95. Carpet segment 131 extends down and under the curved end 124 of plate 118 and is fastened to tension bar 102 by teeth 135 on the top of tension bar 102.

Webbing 136 is attached to the forward edge of cover plate 95 as described above, and extends over the bridging section 117B into a slot 138 formed in tension bar 102, where it is securely fastened. Carpet segment 131 is also glued down onto cover plate 95 and the webbing 136. The overall structure of the expansion joint 90 is such that the carpet segments 130 and 131 are ideally flush and level with the entire expanse of the carpet.

Figure 12:
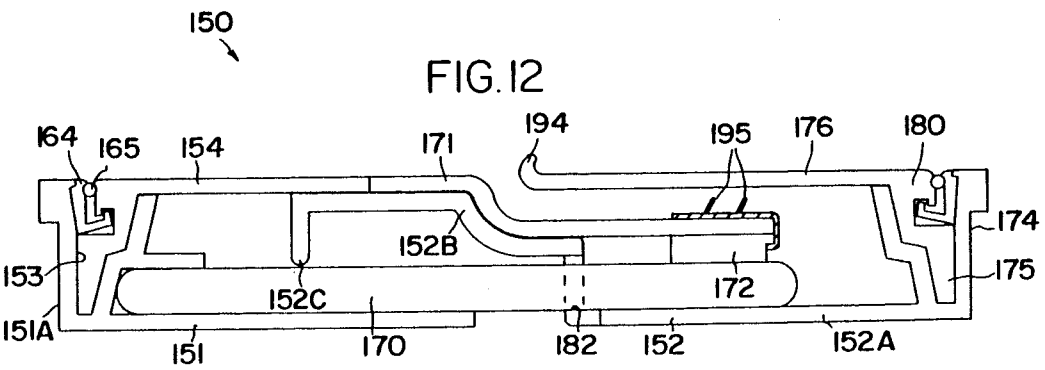
FIG. 12 is a cross-section of the embodiment of the invention shown in FIG. 11.

A simplified version of an expansion joint is illustrated in FIGS. 11 and 12 and indicated at broad reference numeral 150. This expansion joint is suitable in instances where it is not necessary to compensate for relative vertical movement between the adjacent floor sections.

Joint 150 comprises a subchannel 151 positioned on the edge of a concrete floor segment A, and a subchannel 152 positioned on the edge of a concrete floor segment B. Both subchannels 151 and 152 extend along the length of the juncture of adjacent floors segments A and B, and are each formed of extruded aluminum.

Subchannel 151 has a rear wall 151A which terminates in an upwardly directed elongate tapered groove 153. A cover plate 154 is positioned within subchannel 151 by positioning one end in groove 153. Cover plate 154 is therefore mounted in and locked against movement in groove 153.

An elongate clip 164 is positioned in groove 153. An extruded vinyl spline 165 fits over the clip 164 with a press fit, as is best shown in FIG. 11, and holds the cover plate 154 in subchannel 151. Spline 165 locks the adjacent parts together, prevents entry of dirt, dampens noise and eliminates the need for screws. Subchannel 151 also includes a groove 166 for receiving one end of a plurality of spaced-apart actuating pins 170.

A length of a flexible, compression resistant webbing 171 is attached to one end of cover plate 154 and a tension bar 172. Tension bar 172 is securely fastened, as by welding, to the end of actuating pins 170 remote from cover plate 154.

Subchannel 152 has a rear wall 174 which terminates in an upwardly directed elongate annular groove 175. A cover plate 176 is positioned within subchannel 152. Cover plate 176 has an elongate annular rim 180 which is adapted to be pivotally received in groove 175, thereby permitting cover plate 176 to pivot.

An elongate clip 164 is positioned in groove 175. An extruded vinyl spline 165 fits over the clip 164 with a press fit, as is best shown in FIG. 11, and holds the cover plate 176 in subchannel 152. Spline 165 locks the adjacent parts together, prevents entry of dirt, dampens noise and eliminates the need for screws.

Subchannel 152 includes a section 152A in which tension bar 172 is positioned and into which the actuating pins 170 extend through respective holes 182; a bridging section 152B which is raised above the level of section 152A and supports cover plate 154, and a downwardly extending end section 152C which rests on actuating pins 170 and supports cover plates 154 above the level of the bottom of subchannel 151.

A carpet segment 190 is glued onto the top surface of cover plate 176. Cover plate 176 has an upwardly curved end 194 against which the glued down carpet 190 is abutted. A carpet segment 191 is glued down onto cover plate 154. Carpet segment 191 extends down and under the curved end 194 of cover plate 176 and is fastened to tension bar 172 by teeth 195 on the top of tension bar 172.

Webbing 171 is attached to the forward edge of cover plate 154 as described above, and extends over the bridging section 152B into a slot 138 formed in tension bar 172, where it is securely fastened. Carpet segment 191 is also glued down onto cover plate 154 and the webbing 171. The overall structure of the expansion joint 150 is such that the carpet segments 190 and 191 are ideally flush and level with the entire expanse of the carpet. Cover plates 154 and 176 are removed by removing splines 165. Flat plates 95 and 118 are removed by removing splines 105.

It is emphasized that the very portions shown in the drawings are merely representative of a very long length of the expansion joints which may join very large adjacent floor segments in large industrial or commercial buildings.

An expansion joint is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An expansion joint for joining first and second adjacent segments of direct glue down carpet mounted on respective underlying adjacent first and second floor segments, and comprising:

(a) a first subchannel for being mounted in said first floor segment along a joint line of the adjacent first and second carpet segments;

(b) a second subchannel for being mounted in said second floor segment along the joint line of the adjacent first and second carpet segments in parallel relative moveable relation to said first subchannel;

(c) a first cover for supporting the first of the carpet segments on the first subchannel;

(d) a second cover for supporting the other of the adjacent carpet segments on the second subchannel;

(e) tension means for being positioned in said second subchannel for movement to and rom said first subchannel, said tension means including carpet edge grippers for gripping and holding the free edge of the first carpet segment under tension during relative movement between said first and second subchannels thereby allowing expansion and contraction of the adjacent first and second floor segments without stretching or buckling of the overlying direct glue down carpet segments; and (f) actuating means carried in said second subchannel and engaging said first and second subchannels and said tension means for moving said first and second segments of carpet in response to relative movement between said first and second subchannels, said actuating means including an actuating pin fixedly secured to said tension means and engaging said first subchannel, said actuating pin adapted for movement by any contracting movement of the first and second subchannels to move the tension means secured thereto and thereby maintain tension on said first carpet segment.

2. An expansion joint according to claim 1 and including bridging means for supporting said first and second carpet segments in a space between said first and second subchannels.

3. An expansion joint according to claim 1, wherein said tension means comprises an elongate tension bar.

4. An expansion joint according to claim 1, wherein said first and second subchannels comprise extruded aluminum.

5. An expansion joint according to claim 3, wherein said tension means includes a flexible connecting member interconnecting said first cover and said tension bar.

6. An expansion joint according to claim 1, wherein said first and second carpet segments are glued onto respective said first and second covers.

* * * * *